US005220776A

United States Patent [19]

Stahlecker

[11] Patent Number: 5,220,776

[45] Date of Patent: Jun. 22, 1993

[54] SILVER SUPPLY SYSTEM FOR A SPINNING MACHINE

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany; a part interest to each

[21] Appl. No.: 809,143

[22] Filed: Dec. 18, 1991

[30] Foreign Application Priority Data

Dec. 21, 1990 [DE] Fed. Rep. of Germany ..... 4041112
Mar. 20, 1991 [DE] Fed. Rep. of Germany ..... 4109026

[51] Int. Cl.[5] ..... D01H 13/04
[52] U.S. Cl. ..... 57/90; 57/315
[58] Field of Search ..... 57/90, 75, 315; 226/171

[56] References Cited

U.S. PATENT DOCUMENTS

| | | | |
|---|---|---|---|
| 2,896,269 | 7/1959 | Gordella et al. | 57/315 X |
| 3,176,352 | 4/1965 | Ricklin | 226/171 X |
| 3,312,050 | 4/1967 | Noguera | 57/90 |
| 4,009,877 | 3/1977 | Ward, Jr. | 226/171 X |
| 4,716,706 | 1/1988 | Boeckmann | 226/171 X |

FOREIGN PATENT DOCUMENTS

| | | |
|---|---|---|
| 817572 | 10/1951 | Fed. Rep. of Germany . |
| 2335740 | 11/1974 | Fed. Rep. of Germany . |
| 1015780 | 1/1966 | United Kingdom . |

*Primary Examiner*—Joseph J. Hail, III
*Attorney, Agent, or Firm*—Evenson, McKeown, Edwards & Lenahan

[57] ABSTRACT

In the case of a spinning machine for the spinning of yarns from slivers with can feeding, the slivers are guided from the cans to the spinning stations in each case by drivable guide aprons which are disposed opposite stationary sliding surfaces.

19 Claims, 3 Drawing Sheets

Fig. 1
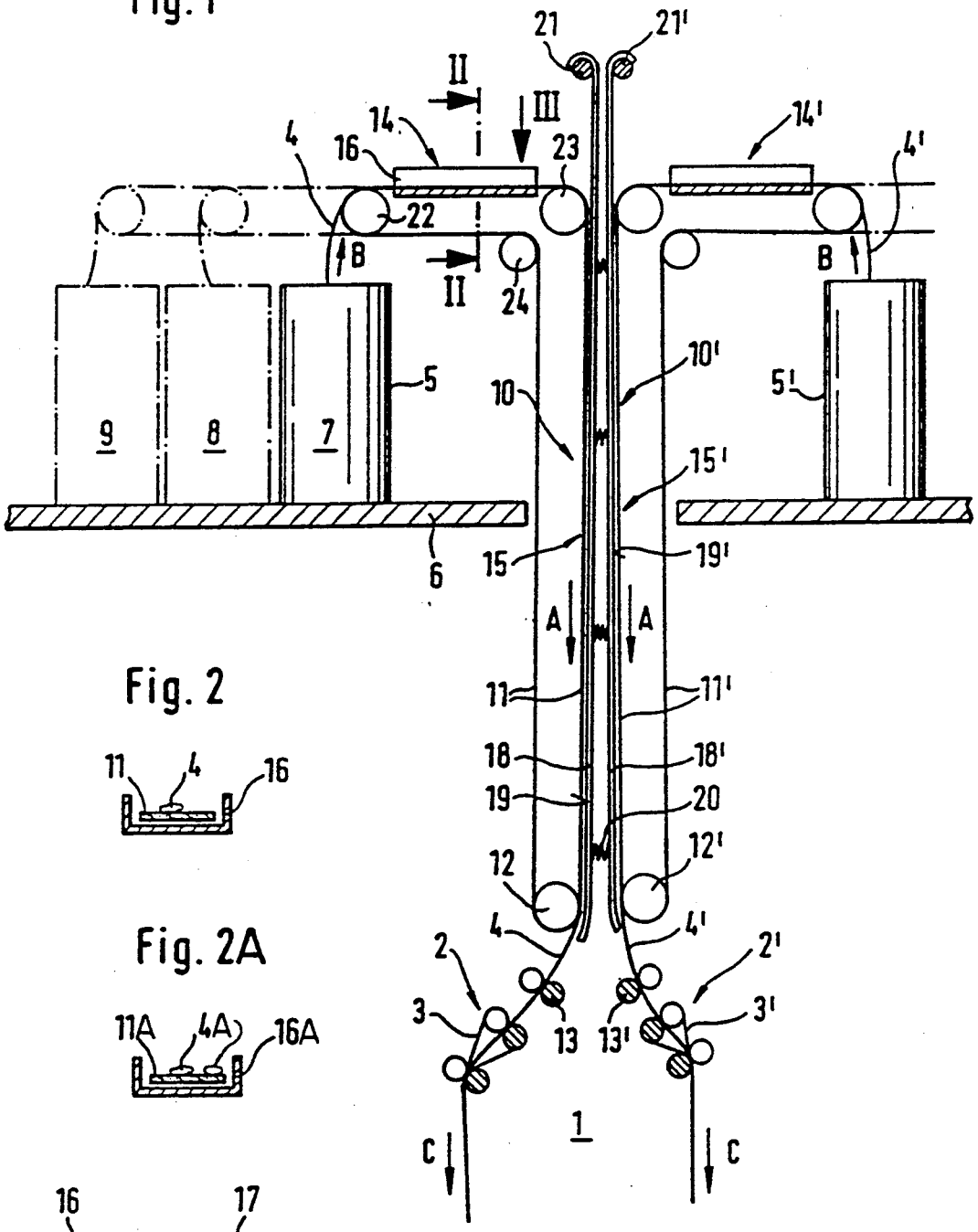
Fig. 2
Fig. 2A
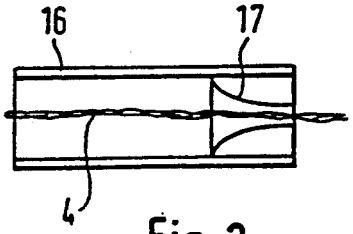
Fig. 3

Fig. 4
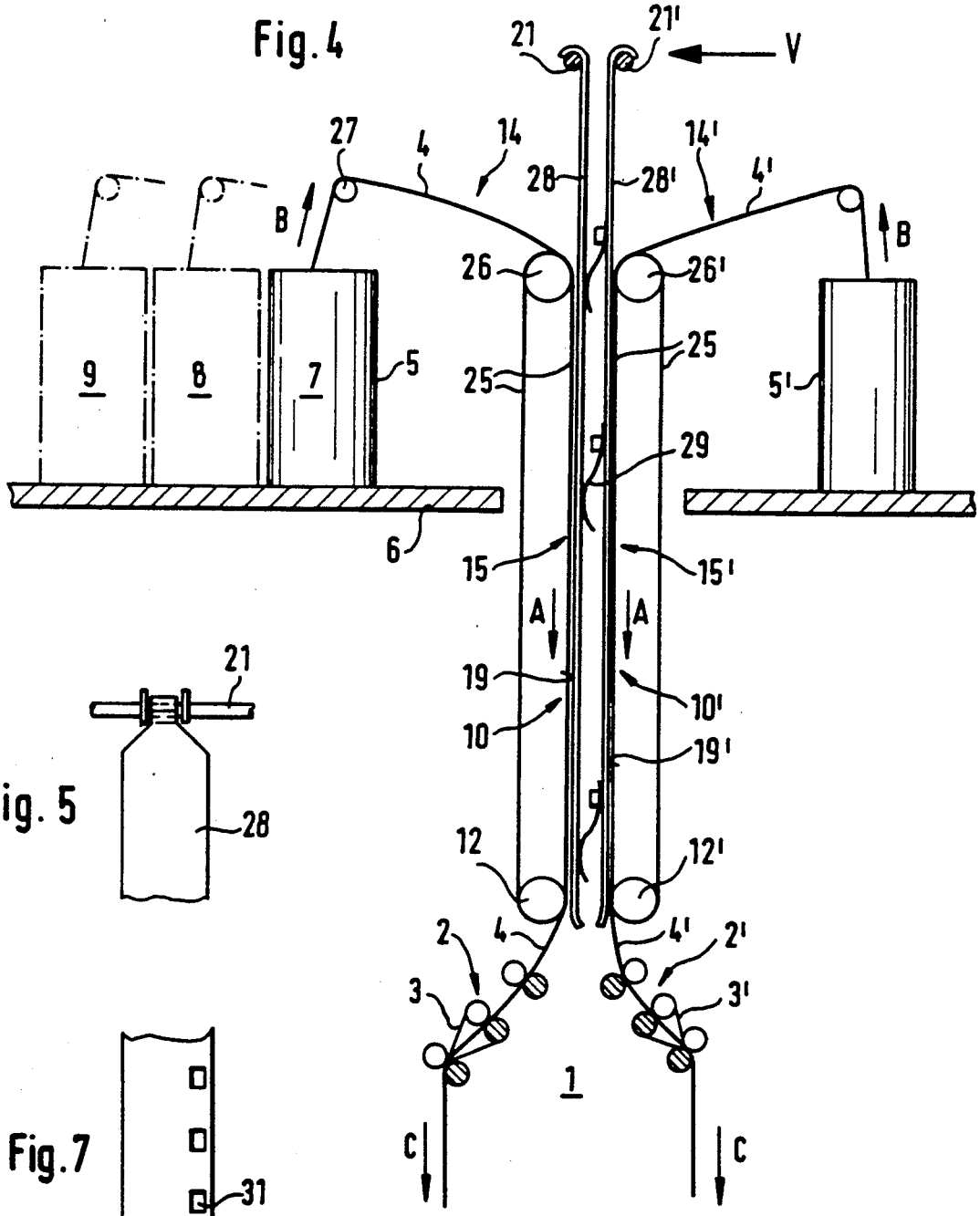
Fig. 5
Fig. 7
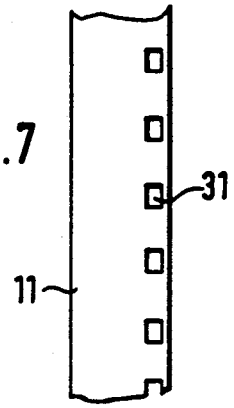
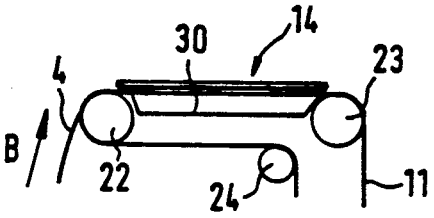
Fig. 6

Fig. 8
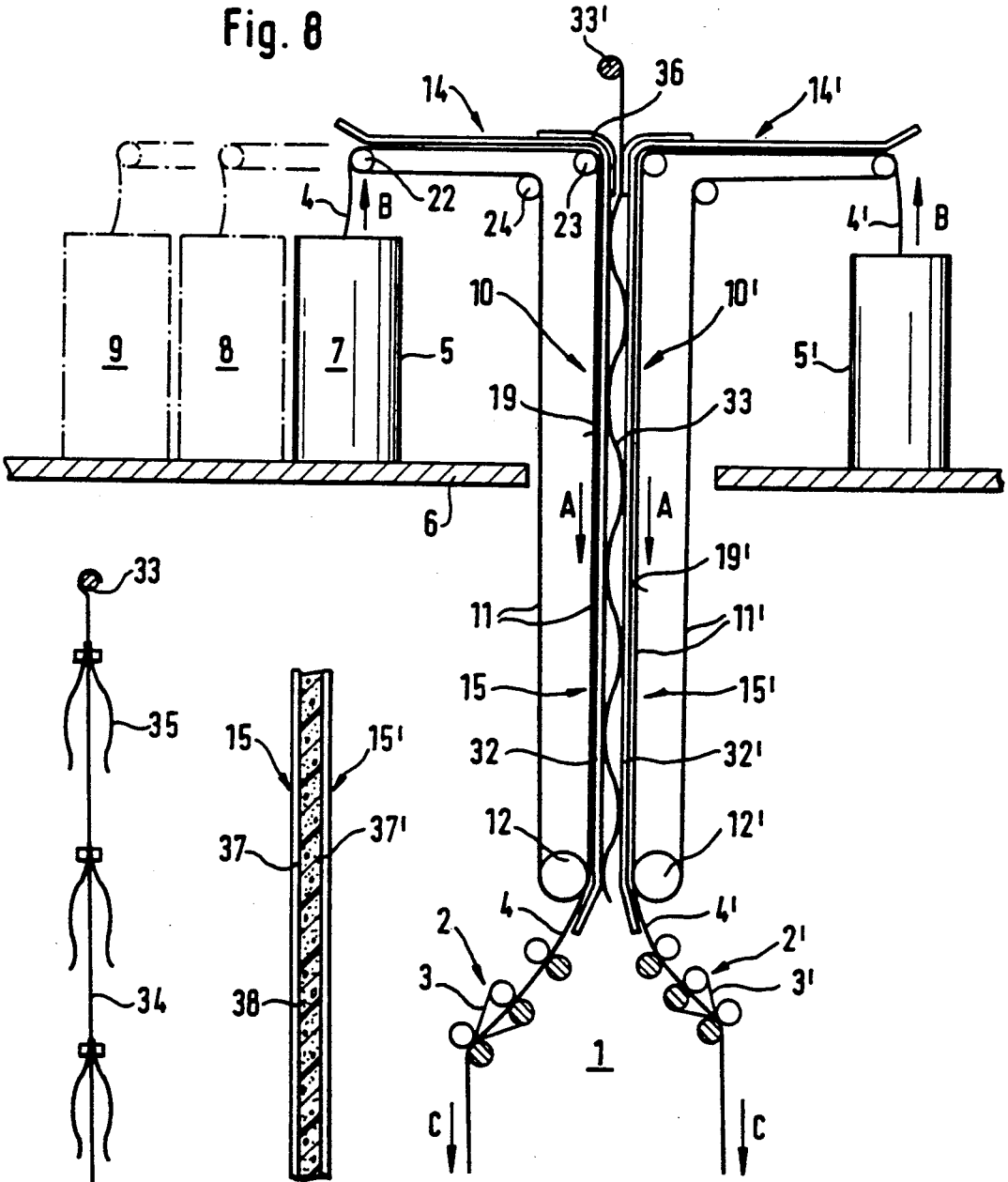
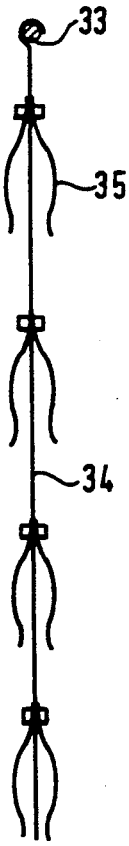
Fig. 9
Fig. 10

SILVER SUPPLY SYSTEM FOR A SPINNING MACHINE

BACKGROUND AND SUMMARY OF THE INVENTION

This invention relates to a spinning machine having several spinning stations for the spinning of yarns from slivers which are fed to the spinning stations in cans, guiding devices for the slivers being arranged between the cans and the spinning stations.

The feeding of the fiber material to be spun in the form of slivers disposed in cans is known, for example, in the case of open-end spinning machines. In the case of the machines currently on the market, the slivers are withdrawn directly by the sliver feeding device of the individual spinning stations from cans standing in front of and partially below the spinning arrangement.

It is also known (German Patent Document DE-C 23 35 740) to arrange the cans, in the case of open-end spinning machines, on a platform above the spinning machine and to feed the slivers to the spinning stations through guide tubes. These guide tubes, which are provided with baffles, are to serve as intermediate storage devices which, because of a special construction, are fed by a continuously running feeding device nevertheless in an intermittent manner. The sliver is then to be guided through the respective guide tube essentially free of tensile stress.

The feeding of the fiber material in the form of slivers made available in cans is known also in the case of other fast-running spinning machines, for example, in the case of wind-around spinning machines or air spinning machines. These are as a rule one-sided machines, in the case of which the slivers are fed to the spinning stations from above and are taken out of the cans deposited on the rear side of the spinning machine. In this case, guiding devices for the slivers are provided in the form of pulleys and guide rods.

It is also known (German Patent Document DE-PS 817 572), in the case of ring spinning machines, to feed slivers in cans, in which case the cans are deposited on platforms or in a space above the spinning machine. This results in relatively long paths with one or several vertical sections which result in the risk that the slivers may hang out; that is, are uncontrollably drafted because of their inherent weight. Such an arrangement is therefore possible only for slivers which have a relatively coarse size and therefore a relatively high strength.

It is also known (British Patent Document GB-PS 1 015 780) to feed the slivers from the cans to the drafting units of the spinning stations of a ring spinning machine by means of guide aprons, in which case two guide aprons respectively receive a sliver between their runs which extend in parallel to one another. In the case of this construction, the cans are deposited next to the ring spinning machine while leaving an aisle. The slivers are withdrawn from the cans, are then guided downward between the cans, are guided inside the floor of the ring spinning machine and are then guided inside the ring spinning machine upward to the drafting units.

However, the spinning of slivers with coarse sizes is very difficult on ring spinning machines. Since ring spinning machines have only a relatively low delivery rollers of the drafting units—while taking into account the required draft—must run very slowly, that is, at rotational speeds of one revolution per minute and less.

Technically, it is extremely difficult to let long shafts, as represented by the feeding rollers of drafting units, run with sufficient precision at such low rotational speeds. There is the danger that these shafts rotate only jerkily so that then no controlled draft will be obtained. The feeding in cans of the fiber material to be spun in cans has therefore not been carried out successfully in practice in the case of ring spinning machines.

It is an object of the invention to develop a spinning machine of the initially mentioned type such that particularly fine slivers can be spun without the danger of faulty drafts of the slivers during the transport from the cans to the spinning stations.

This object is achieved in that the guiding devices comprise drivable guide aprons which run into the transport direction of the slivers and the transport surfaces of which receiving the slivers are covered at least along a part of their length by means of essentially stationary elements which have sliding surfaces facing the transport surfaces.

In the case of the development according to the invention, it is achieved that the slivers are supported but are nevertheless moved in the transport direction. As a result, it is possible to feed also relatively thin slivers in cans, that is, slivers with sizes of approximately Nm 0.4 to 0.8. In this case, these fine slivers can also be transported along larger sections in the vertical direction. It is therefore possible to carry out a can feeding also in the case of ring spinning machines because, as a result of the slivers with the fine sizes, while the draft is taken into account, the feeding roller pairs of the drafting units still run at a sufficiently high speed so that a uniformly round rotating is ensured. As a result of this can feeding, it will then be possible, in the case of ring spinning machines, to do without a machine connected in front of it, specifically a flyer. In the case of other spinning machines which are provided with drafting units into which the slivers enter, it is possible to feed finer slivers so that then the drafting units may be simplified. For example, in the case of machines of this type, there exists the possibility to use, instead of the five-cylinder drafting units, the three-cylinder drafting units which are customary in the case of ring spinning machines today.

Also in the case of open-end machines, the feeding of finer slivers results in advantages because then the opening-up work for the separating of the fibers will be less so that the fibers are processed more carefully during the opening-up. It is therefore possible to spin finer yarns with less damaged fibers so that the yarns have a higher quality.

Mainly, the elements with the sliding surfaces are assigned to essentially vertical sections of the guide aprons. The sliding surfaces are loaded by a force of approximately 0.2N to approximately 1.5N in the direction of the guide apron. The contact pressure force onto the sliver is therefore very low. It only has the purpose of securely guiding the sliver and avoiding faulty drafts, in which case the sliding guiding results in a certain smoothing.

In a particularly advantageous development of the invention, the sliding surfaces are a component of strip-type skids. In an embodiment, two skids are provided which are arranged vertically at a distance from one another, which are pressed apart by elastic devices and which are each assigned to one side of the machine. As a result, the expenditures can clearly be reduced.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial cross-sectional view of a spinning machine, in which case only one drafting unit respectively is shown of the two sides of the machine, to which a sliver is guided from a can deposited on a platform, in which case the sliver is transported by a guide apron against which a sliding surface is pressed in an elastic manner, constructed according to a preferred embodiment of the invention;

FIG. 2 is a sectional view along the plane of section II—II of FIG. 1;

FIG. 2A is a sectional view similar to FIG. 1, showing a modified embodiment carrying a plurality of slivers side-by-side;

FIG. 3 is a view of a detail in the direction of the arrow III of FIG. 1;

FIG. 4 is a partial cross-sectional view of a spinning machine similar to FIG. 1, showing a further preferred embodiment of the invention;

FIG. 5 is a view of a detail of FIG. 4 in the direction of the arrow V of FIG. 4;

FIG. 6 is a view of a detail from FIG. 1 with another development in the area of the horizontal section of the guide apron;

FIG. 7 is a partial view of a guide apron which can be driven in a form-fitting manner;

FIG. 8 is a partial cross-sectional view of a spinning machine similar to FIG. 1 and 4, showing a further preferred embodiment of the invention;

FIG. 9 is a schematic view of sheet metal strip with leaf springs for the loading of the sliding surfaces riveted to it constructed according to a preferred embodiment of the invention; and FIG. 10 is a view of two sliding skids which comprise the sliding surfaces and have a narrow distance from one another which is filled with an elastic filler, constructed according to another preferred embodiment of the invention.

DETAILED DESCRIPTION OF THE DRAWINGS

FIG. 1 illustrates only two spinning stations 2 and 2' of a spinning machine 1, which stations are at respective sides of the machine and of which only one drafting unit 3 or 3' is shown. However, a spinning machine 1 of this type comprises a plurality of spinning stations 2 and 2' of this type which are arranged in a row next to one another on one side of the machine or on both sides of the machine. Each drafting unit 3, 3' is followed by a twist-providing device, which is not shown, such as a ring spindle or a wind-around spindle or an air nozzle. Likewise, a sliver feeding device of an open-end spinning machine may be disposed at the location of the drafting unit 3, 3'. At each of these spinning stations 2, 2', a sliver 4, 4' is taken out of a can 5 or 5' and is spun into a yarn.

In the case of the embodiment according to FIG. 1, the cans 5, 5' of the individual spinning stations 2, 2' are each disposed above the spinning machine 1 on a platform 6. The cans 5, 5', which normally have an outside diameter which is larger than the spacing of the spinning stations 2, 2' (distance between the centers of the spinning stations in the longitudinal direction of the machine), are deposited in several rows 7, 8, 9 extending in the longitudinal direction of the spinning machine 1, as indicated by a dash-dotted line on the left side in FIG. 1.

The slivers 4, 4' are withdrawn upwards in the direction of the arrow (B) from the cans 5, 5', which are open on top, are conveyed for a section of the path in the horizontal direction and are then transported downward in the direction of the arrow (A) to the drafting units 3, 3'. In order to securely bridge this section of the path also in the case of fine sizes of the slivers 4, 4' without the occurrence of faulty drafts in the fine slivers 4, 4', special guiding devices 10, 10' are provided. The slivers 4, 4', which are subsequently drafted in the drafting units 3, 3', are guided in the direction of the arrow (C) to a twist-providing device which is not shown.

For each spinning station 2, 2', the guiding devices 10, 10' each comprise an endless guide apron 11, 11' which is driven in the direction of the arrow (A) by a driving pulley 12, 12'. The driving pulleys 12, 12' at the same time operate as deflecting pulleys and are situated directly in front of the respective feeding roller pair 13, 13' of the pertaining drafting unit 3, 3'.

In the area of the cans 5, 5', the guide apron 11, 11' has a horizontally extending section 14, 14' which subsequently changes into a vertically extending section 15, 15'. In the horizontal section 14, 14', the respective guide apron 11, 11' runs in a rail 16 with a U-shaped cross-section, as shown particularly also in FIG. 2. The sliver 4, which rests in the center on the respective guide apron 11, is supported without any contact pressure from above, alone by its inherent weight. At the end of the rail 16, where the horizontal section 14 changes into the vertical section 15, the rail 16 has an edge bordering device 17 which ensures a central centering of the sliver 4 before it moves onto its path into the vertical section 15. This edge bordering device 17 has the purpose of preventing that the edge fibers move too far in the lateral direction from the center of the sliver 4 (see FIG. 3).

In the vertical section 15, 15', two skids 18, 18' are provided approximately in the center of the spinning machine 1. The skids 18, 18', which consist of thin steel bands, each have a sliding surface 19, 19' which places itself softly against the respective sliver 4, 4' A contact pressure of from 0.2N to 1.5N is sufficient. The skids 18, 18' which extend vertically downward at a narrow distance are pressed apart by means of spring elements 20, in which case the desired slight resting and loading of the respective sliver 4, 4' is achieved.

Above the horizontal sections 14, 14' of the guiding devices 10, 10', longitudinal rods 21, 21' are mounted on which skids 18, 18' are suspended which are constructed in a strip shape. For this purpose, the skids 18, 18' are slightly rolled in in the area of the longitudinal rods 21, 21'. As a result of the effect of the spring elements 20, the skids 18, 18' can therefore be swivelled about the longitudinal rods 21, 21'.

The sliding surfaces 19, 19' are constructed such that, when they leave the respective guide apron 11, 11' in the area of their driving pulleys 12, 12', they guide the respective sliver 4, 4' to the feeding rollers 13, 13' of the pertaining drafting unit 3, 3'.

As also illustrated in FIG. 1, each guide apron 11, 11', in addition to the lower driving pulley 12, 12', also has respective deflecting rollers 22, 23, 24 which deflect the respective guide apron 11, 11' from the horizontal section 14, 14' to the vertical section 15, 15'.

In the embodiments described in the following, the same reference symbols were used to the extent that the same components were concerned. The description was therefore not repeated.

In the embodiment according to FIG. 4, a simplified guide apron 25, 25' is provided which is assigned only to the respective vertical section 15, 15' and which, in addition to the driving pulley 12, 12', only has a deflecting pulley 26, 26' above the platform 6. In the horizontal sections 14, 14', the respective sliver 4, 4' is unguided. Such a simplification may be used in the case of the spinning of carded slivers 4, 4'. Above the cans 5, 5', deflecting rollers 27 are arranged which are driven at a circumferential speed which is slightly higher than the speed of the slivers 4, 4'.

Also in this embodiment, there are longitudinal rods 21, 21' on which two skids 28, 28' are hung in. The two skids 28, 28' run in the center of the spinning machine 1 in the vertical direction at a narrow distance from one another and are pressed apart by means of leaf springs 29 so that the sliding surfaces 19, 19' are placed with a slight contact pressure against the respective guide apron 25, 25' of the guiding devices 10, 10'. In this case it is sufficient for the leaf springs 29 to be fastened to only one skid 28'.

It is expedient for the longitudinal rods 21, 21' to be situated sufficiently far above the deflecting pulleys 26, 26'. Furthermore, it is expedient for the sliding surfaces 19, 19' to extend precisely symmetrically between the guide aprons 25, 25' so that precisely the same contact pressures are ensured in the area of the deflecting pulleys 26, 26'.

FIG. 5 shows in a different view how the skids 28 are hung in on the longitudinal rod 21.

FIG. 6 again shows the horizontal section 14 of an embodiment similar to FIG. 1 in which a rail 30 exists which is turned with respect to the construction according to FIG. 1 so that the transverse web of the U-shaped rail 30 made of a steel strip with its weight loads the sliver 4 from above and thus also the guide apron 11.

As indicated in FIG. 7, the guide apron 11 may be provided with a lateral perforation 31 which engages in tooth-type projections of a driving pulley so that a form-locking drive is ensured in which there is no slip whatsoever.

In the embodiment according to FIG. 8, two skids horizontal section 14, 14' as well as along the vertical section 15, 15' of the guiding devices 10, 10'. In the vertical section 15, 15', the skids 32, 32' are pressed slightly apart by means of a corrugated strip spring 33 so that the pertaining sliding surfaces 19, 19' are placed with a slight contact pressure against the pertaining sliver 4, 4'. The corrugated spring 33 is suspended above the horizontal section 14, 14' on a longitudinal rod 33'. Instead of a corrugated strip spring 33, however, a strip 34 may be suspended on a longitudinal rod 33' as an alternative according to FIG. 9, to which a plurality of leaf springs 35 are riveted.

In the embodiment according to FIG. 8, the skids 32, 32' were not suspended on longitudinal rods so that they can be swivelled. On the contrary, these skids 32, 32' are bent in such a manner that they cover the sliver 4, 4' with a slight load also in the horizontal section 14, 14'. Since the preferably thin, spring hard skids 32, 32' made of steel strip cannot be bent sufficiently securely and durably, reinforcing plates 36 should be mounted by means of riveting in the area of the deflection between the horizontal and vertical sections.

In the horizontal sections, 14, 14', the skids 32, 32' are guided so far above the cans 5, 5' that the respective sliver 4, 4' will easily find its path into the guiding devices 10, 10'.

In the case of the embodiment according to FIG. 10 which is shown only as a cutout, two skids 37, 37' are shown which in the vertical section 15, 15' again extend closely next to one another in parallel, the space between them being filled by an elastic filler 38. This may be a mattress-type foamed material which presses the skids 37, 37' slightly apart and thus loads the respective sliver 4, 4' very uniformly.

Since, in the case of drafting units, as a rule, two adjacent drafting units have common supporting elements for the pressure rollers, it is useful to construct the guide aprons 11, 11' so wide that they can accommodate two slivers 4, 4' which run next to one another. FIG. 2A schematically depicts an arrangement with two slivers 4A on a single guide apron 11A. The elements with the sliding surfaces (skids or rails) will then be designed to be correspondingly wide.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a spinning station for spinning yarns from slivers, a sliver supply can for supplying sliver for the spinning station, and sliver transport apparatus for transporting sliver from the sliver supply can to the spinning station without applying substantial drafting forces to the sliver, said sliver transport apparatus including:

a drivable guide apron which travels in the transport direction of the sliver, said guide apron exhibiting a transport surface which supports the sliver during transport thereof, and a stationary slide element which exhibits a stationary sliding surface facing the transport surface and engaging the sliver as it is transported by the transport surface.

2. A spinning machine according to claim 1, wherein the sliding surface extends substantially parallel to an essentially vertical section of the guide apron.

3. A spinning machine according to claim 2, comprising force loading apparatus for loading the slide element with a force of approximately 0.2N to approximately 1.5N in the direction of the pertaining guide apron transport surface.

4. A spinning machine according to claim 1, comprising force loading apparatus for loading the slide element with a force of approximately 0.2N to approximately 1.5N in the direction of the pertaining guide apron transport surface.

5. A spinning machine according to claim 4, wherein the loading apparatus includes spring elements for elastically loading the slide element in the direction of the pertaining guide apron transport surface.

6. A guiding apparatus according to claim 4, wherein said guide apron is configured to transport a plurality of slivers side-by-side on the transport surface thereof.

7. A spinning machine according to claim 1, comprising holding apparatus for holding the slide element so that it can be moved selectively away from the pertaining guide apron transport surface.

8. A spinning machine according to claim 1, wherein the slide element is constructed as a strip-type skid.

9. A spinning machine according to claim 8, wherein two essentially vertically extending skids are provided which are arranged at a distance from one another, are pressed apart by elastic devices, and are assigned to respective guide aprons of opposite sides of the machine.

10. A spinning machine according to claim 9, wherein the elastic devices are spring elements.

11. A spinning machine according to claim 10, wherein the spring elements are constructed as a corrugated-strip spring.

12. A spinning machine according to claim 10, wherein elastic fillers are provided as the elastic devices.

13. A spinning machine according to claim 1, comprising a form-fitting device for driving the guide apron.

14. A spinning machine according to claim 1, wherein the guide apron has an essentially horizontal section in the area of the can, comprising one guide rail respectively being assigned to said horizontal section.

15. A spinning machine according to claim 14, wherein the guide rail and the sliding surface are disposed opposite the transport surface of the guide apron.

16. A spinning machine according to claim 15, wherein the guide rail is provided with devices for the centering of the sliver in an area of transition from the approximately horizontal section of the guide apron to the approximately vertical section thereof.

17. A spinning machine according to claim 14, wherein the guide rail is provided with devices for the centering of the sliver in an area of the transition from the approximately horizontal section of the guide apron to the approximately vertical section.

18. A spinning machine according to claim 1, comprising a plurality of said spinning stations, cans and sliver transport apparatus.

19. A spinning machine according to claim 1, wherein said guide apron is configured to transport a plurality of slivers side-by-side on the transport surface thereof.

* * * * *